United States Patent [19]

Burack et al.

[11] Patent Number: 4,963,293

[45] Date of Patent: Oct. 16, 1990

[54] FLOW CONTROL METHOD FOR DECONTAMINATING RADIOACTIVELY CONTAMINATED NUCLEAR STEAM GENERATOR

[75] Inventors: Robert D. Burack, Pleasant Hills; August J. Friedrich, Bethel Park; Albert J. Dietrich, North Huntingdon, all of Pa.

[73] Assignee: Westinghouse Electric Corp., Pittsburgh, Pa.

[21] Appl. No.: 501,979

[22] Filed: Jun. 7, 1983

[51] Int. Cl.[5] ..... G21F 9/00

[52] U.S. Cl. ..... 252/626; 376/310; 165/95; 134/22.12

[58] Field of Search ..... 252/626; 134/3, 22.12; 376/309, 310, 316; 165/95; 122/379, 396

[56] References Cited

U.S. PATENT DOCUMENTS

| | | | |
|---|---|---|---|
| 3,873,362 | 3/1975 | Mihram et al. | 252/626 |
| 4,226,640 | 10/1980 | Bertholdt | 252/626 |
| 4,318,786 | 3/1982 | Lahoda et al. | 204/141.5 |
| 4,320,528 | 3/1982 | Scharton et al. | 376/310 |
| 4,326,317 | 4/1982 | Smith et al. | 15/302 |
| 4,374,462 | 2/1983 | Wojcik et al. | 51/411 |

FOREIGN PATENT DOCUMENTS

| | | |
|---|---|---|
| 1001560 | 7/1957 | Fed. Rep. of Germany . |
| 1204415 | 1/1960 | France . |
| 2064852 | 6/1981 | United Kingdom . |

OTHER PUBLICATIONS

Larrick, A. P., "Decontamination of the N Reactor Steam Generators", in Ayres, J. A. Ed., *Decontamination of Nuclear Reactors and Equipment*, The Ronald Press Company, N.Y. (1970), pp. 543–551.

*Primary Examiner*—Edward A. Miller
*Assistant Examiner*—Ngoclan Mai
*Attorney, Agent, or Firm*—Louis A. DePaul

[57] ABSTRACT

The invention comprises a method for conducting a decontamination solution into a nuclear steam generator for radioactively decontaminating the nuclear steam generator. The invention also comprises controlling the level of the decontamination solution in the heat exchange tubes of the nuclear steam generator in a manner to raise and lower, sequentially, the level of the decontamination solution in the tubes so as to replenish the decontamination solution in the tubes and to carry away the radioactive contaminates.

15 Claims, 2 Drawing Sheets

FLOW CONTROL METHOD FOR DECONTAMINATING RADIOACTIVELY CONTAMINATED NUCLEAR STEAM GENERATOR

BACKGROUND OF THE INVENTION

This invention relates to radioactive decontamination methods and more particularly to flow control methods for radioactively decontaminating nuclear steam generators.

A major problem encountered in performing maintenance on nuclear power plant equipment is the radiation exposure of maintenance personnel. Since the coolant that circulates through the nuclear reactor system is exposed to radiation, the coolant carries the radioactivity through most of the components of the nuclear reactor system. This circulation of the coolant through the nuclear reactor system causes many of the components of the nuclear reactor to become radioactive. Occasionally, over the life of the nuclear power plant, certain of the components of the nuclear power plant system need to have maintenance performed on them. When it is necessary to perform maintenance on these components, it is sometimes necessary for maintenance personnel to come in close contact with these components. Since the components are radioactive, care must be taken by the working personnel to avoid overexposure from this radiation. When the operations to be performed on these components requires a great deal of time, the radiation field associated with the contaminated components poses great difficulty in performing these operations because of the limited time in which any particular working personnel may be allowed to be present near the component. Under certain circumstances the radiation field of the component may greatly extend the time to perform the maintenance and it may also greatly increase the number of working personnel needed to perform the task because each of the personnel may only be present near the component for a limited amount of time. Therefore, it has become necessary to develop techniques for reducing the radiation field associated with these components so that working personnel may be present near the components for a greater length of time so as to be able to perform the maintenance procedures in an expedient manner.

It has been known that the radiation field associated with these components is produced by the radioactivity deposited in the thin oxide film that has become deposited on the inside surfaces of these components. Methods for reducing the radioactive field associated with these components have centered on removing the radioactive metal oxide film without damaging the component. Methods which have been tried to remove this metal oxide film include grit blasting, rinsing the components with solutions, and wiping of the surface. Difficulties which arise with some of these methods include the inability to easily clean the rough surface of some types of components, the airborne radiation caused by removing the oxide film such as in grit blasting, and possible contamination of the primary or secondary side cooling water by residual materials from these methods. Therefore, what is needed is a method for radioactively decontaminating components of nuclear power plants so that maintenance may be performed thereon without damaging the component or spreading the contaminates throughout the reactor system.

SUMMARY OF THE INVENTION

The invention comprises a method for conducting a decontamination solution into a nuclear steam generator for radioactively decontaminating the nuclear steam generator. The invention also comprises controlling the level of the decontamination solution in the heat exchange tubes of the nuclear steam generator in a manner to raise and lower, sequentially, the level of the decontamination solution in the tubes so as to replenish the decontamination solution in the tubes and to carry away the radioactive contaminates.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

In nuclear power plant systems, it is occasionally necessary to inspect or repair various components of the system. Before inspection or repair can be made, it is sometimes advisable to radioactively decontaminate the components so as to reduce the radiation field associated with the component. The invention described herein provides a method for circulating a radioactive decontamination solution through a nuclear steam generator for reducing the radiation level associated with the nuclear steam generator.

Figure 1:
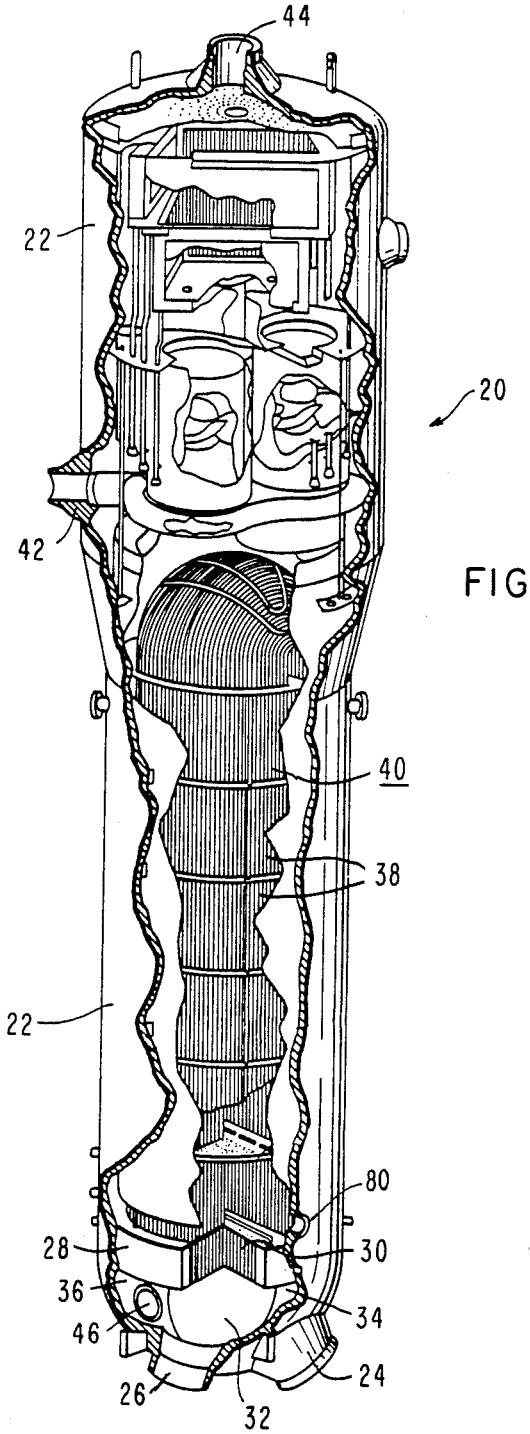
FIG. 1 is a cross-sectional view in elevation of a nuclear steam generator.

Referring to FIG. 1, a nuclear steam generator referred to generally as 20, comprises an outer shell 22 with a primary fluid inlet nozzle 24 and a primary fluid outlet nozzle 26 attached thereto near its lower end. A generally cylindrical tube sheet 28 having tube holes 30 therein is also attached to outer shell 22 near its lower end. A dividing plate 32 attached to both tube sheet 28 and outer shell 22 defines a primary fluid inlet plenum or first channel head 34 and a primary fluid outlet plenum or second channel head 36 in the lower end of the steam generator as is well understood in the art. Tubes 38 which are heat transfer tubes shaped in a U-like curvature are disposed within outer shell 22 and attached to tube sheet 28 by means of tube holes 30. Tubes 38, which may number about 3500, form a tube bundle 40. In addition, a secondary inlet nozzle 42 is disposed on outer shell 22 for providing secondary fluid such as water while steam outlet nozzle 44 is attached to the top of outer shell 22.

As is well understood in the art, the portion of steam generator 20 wherein the reactor coolant (primary fluid) flows is generally referred to as the primary side of the steam generator. Similarly, the portion of steam generator 20 wherein the secondary fluid (the water that is vaporized) flows is generally referred to as the secondary side of the steam generator.

In operation, the primary fluid which may be water having been heated by circulation through the nuclear reactor core enters steam generator 20 through primary fluid inlet nozzle 24 and flows into first channel head 34. From first channel head 34, the primary fluid flows upwardly through tubes 38, through tube sheet 28, up through the U-shaped curvature of tubes 38, down through tubes 38 and into the second channel head 36, where the primary fluid exits the steam generator through primary fluid outlet nozzle 26. While flowing through tubes 38, heat is transferred from the primary fluid to the secondary fluid which surrounds the tubes 38 causing the secondary fluid to vaporize. The resulting steam then exits the steam generator through steam outlet nozzle 44. On occasion, it is necessary to inspect or repair tubes 38 or the welds between tubes 38 and tube sheet 28 to assure that the primary fluid, which may contain radioactive particles, remains isolated from the secondary fluid. Therefore, manways 46 are provided in outer shell 22 to provide access to both first channel head 34 and second channel head 36 so that access may be had to the entire tubesheet 28.

When it becomes necessary to inspect or repair steam generator 20, steam generator 20 is deactivated and drained of its primary fluid. When drained of the primary fluid, first channel head 34, second channel head 36 and tubes 38 are thus drained of reactor coolant so that working personnel may enter first channel head 34 and second channel head 36. However, before working personnel enter first channel head 34 and second channel head 36, it is sometimes advisable to first radioactively decontaminate those areas so that working personnel may remain in those areas for a longer time to perform inspection or repair services.

In order to radioactively decontaminate first channel head 34, second channel head 36 and at least a portion of tubes 38, a decontamination solution may be introduced into first channel head 34, second channel head 36 and tubes 38 for the purpose of removing radioactive contamination therefrom and thus reducing the radiation field associated with those contaminates. One decontamination solution and method that may be used to radioactively decontaminate these portions of nuclear steam generator 20 is described in copending U.S. patent application Ser. No. 501,980, filed herewith, in the name of A. P. Murray, et al., and entitled Decontamination of Metal Surfaces in Nuclear Power Reactors, which is assigned to the Westinghouse Electric Corporation.

In addition to selecting an appropriate decontamination solution and circulating that solution in contact with the surfaces of first channel head 34 and second channel head 36, it is also necessary to be able to circulate the decontamination solution into at least a portion of tubes 38 because it has been found that approximately 20 percent of the radiation field in first channel head 34 and second channel head 36 is associated with the radioactive contamination located in the first one foot of tubes 38 immediately adjacent tube sheet 28. Also, by circulating the decontamination solution into the first four-six feet of tubes 38, a sufficient amount of oxide film can be removed to facilitate inspection or repair procedures such as sleeving. Thus, by removing the oxide film not only is the radiation field reduced but also corrosion products are removed thereby improving the mechanical qualities of the surface. Therefore, it is important to be able to also decontaminate approximately four-six feet of tubes 38 that extend from the first channel head 34 and second channel head 36.

In addition to introducing the decontamination solution into the portion of the tubes 38, it is also important that the temperature of the decontamination solution while in tubes 38 be maintained at a proper level and that the solution be drained from tubes 38 and reconstituted so that the decontamination solution located in tubes 38 is at the proper temperature and concentration. The invention described herein provides a method for circulating the decontamination solution into the channel heads of the steam generator and into a portion of the tubes 38 while maintaining the proper temperature and composition of the solution in tubes 38.

Figure 2:
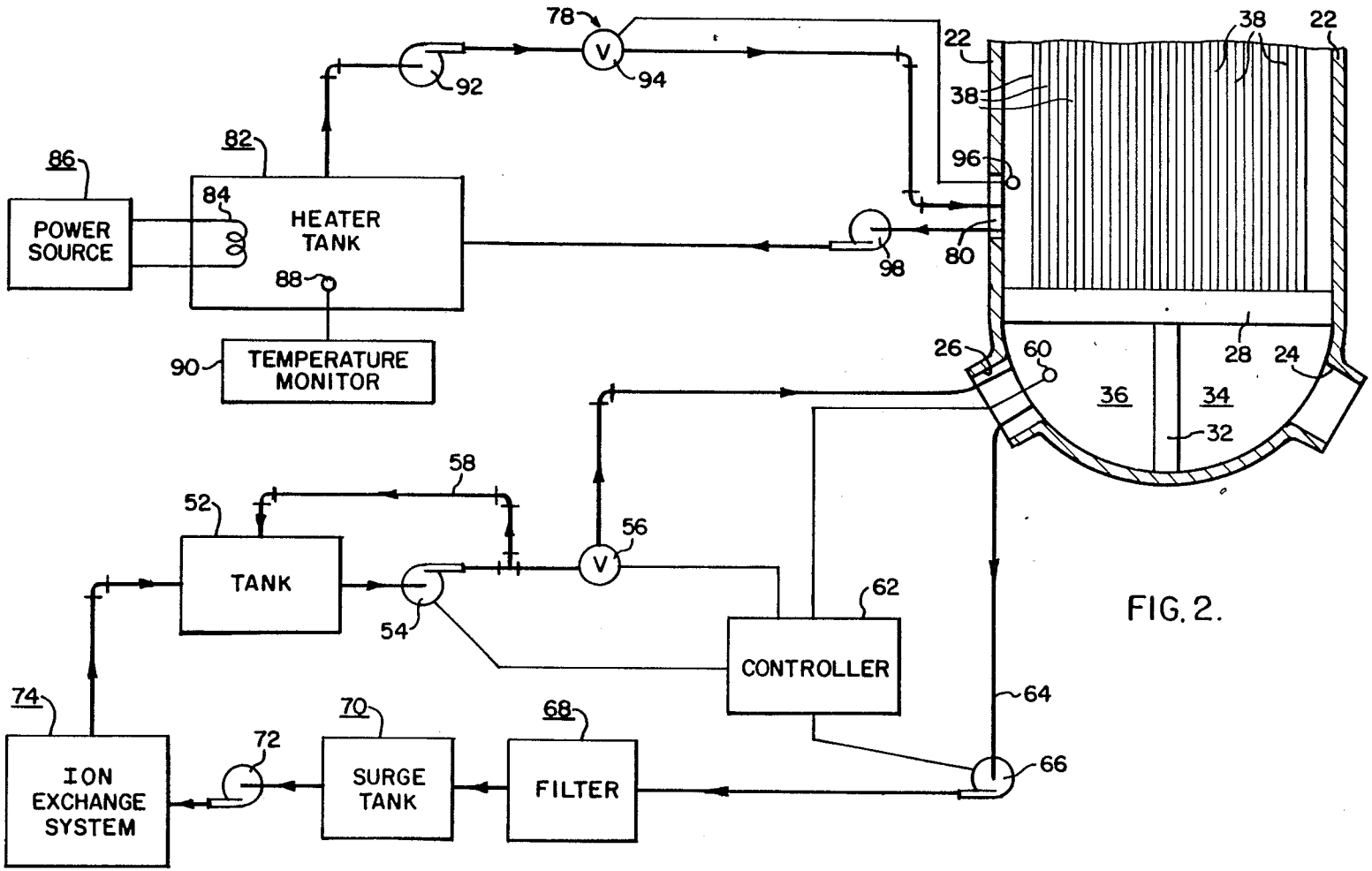
FIG. 2 is a schematic diagram of the decontamination system.

Referring now to FIG. 2, the fluid control system is referred to generally as 50 and is a fluid circulation system that is capable of being mounted on a remotely movable platform such as a trailer and remotely connected to steam generator 20 as shown in FIG. 2. Fluid control system 50 provides a mechanism by which the decontamination solution may be circulated through the portion of the steam generator 20 to be decontaminated while maintaining the proper flow, pressure, temperature, and composition of the decontamination solution in steam generator 20.

Fluid control system 50 comprises a tank 52 which may be a 3,000 gallon tank mounted on a tank truck or a trailer and having an electrical heating system associated with the tank for heating the fluid in the tank to between 175°–250° F. and preferably to approximately 205° F. Tank 52 is connected by appropriate conduits to a first pump 54 which may be a centrifugal type pump capable of operating between approximately 0 to 100 gallons per minute and at a pressure of approximately 120 psi. First pump 54 is connected by conduits to a flow control valve 56 which is in turn connected to a channel head of steam generator 20 such as second channel head 36. A recirculating conduit is connected to the conduit between first pump 54 and flow control valve 56 and extends to tank 52 as shown in FIG. 2. Recirculating conduit 58 provides a means by which the flow from first pump 54 may be recirculated back to tank 52 rather than through flow control valve 56. In this manner, the amount of fluid flowing into steam generator 20 may be controlled. Of course, other arrangements of conduits and valves may be used to achieve the same result.

A fluid level sensor 60 which may be a pressure transducer is disposed in second channel head 36 and attached to an electrical line that extends from second channel head 36 and is connected to controller 62 for determining the level of fluid in second channel head 36 and tubes 38. Controller 62 which may be a microprocessor or an analog controller is also electrically connected to flow control valve 56 for automatically adjusting the flow through flow control valve 56. The electrical connection of fluid level sensor 60 to controller 62 and the electrical connection of controller 62 to flow control valve 56 provides a mechanism by which flow control valve 56 may be automatically adjusted to throttle the flow through flow control valve 56 in response to the level of fluid in steam generator 20. In this manner, the level of the fluid in steam generator 20 may be automatically adjusted.

In initial operation, the flow of fluid from tank 52 through first pump 54 and flow control valve 56 is at the rate of approximately 100 gallons per minute until the level of fluid in second channel head 36 and tubes 38 reaches the desired predetermined level. The desired predetermined level may be approximately six feet into tubes 38 which is approximately four feet above tube sheet 28. When the level of fluid reaches the desired level, an electrical signal is sent to controller 62 and to flow control valve 56 so that flow control valve 56 is closed such that the flow through flow control valve 56 is reduced to zero. Since first pump 54 normally operates at a rate of approximately 100 gallons per minute, when flow control valve 56 is closed the flow of approximately 100 gallons per minute of fluid is automatically diverted through recirculating conduit 58 back to tank 52.

A return line which may be a flexible conduit, is connected to second channel head 36 and to second pump 66 for pumping the fluid from second channel head 36 and to filter 68. Second pump 66 may be an air driven pump capable of operating at approximately 50 gallons per minute when the level of fluid in steam generator 20 is rising and capable of operating at approximately 75 gallons per minute when it is desired to lower the level in steam generator 20. Second pump 66 is also electrically connected to controller 62 such that controller 62 can automatically adjust the flow through second pump 66 in response to the fluid level in steam generator 20. When it is desired to raise the level of fluid in second channel head 36 and tubes 38, flow control valve 56 is adjusted so that approximately 100 gallons per minute is permitted to flow through flow control valve 56 and into steam generator 20. At the same time, second pump 66 is operated at approximately 50 gallons per minute thereby removing 50 gallons per minute of fluid from second channel head 36. In this manner, the level of fluid in second channel head 36 and tubes 38 increases at the rate of approximately 50 gallons per minute. However, when it is desired to lower the level of fluid in second channel head 36 and tubes 38, second pump 66 is operated at the rate of approximately 75 gallons per minute while fluid control valve 56 diverts all of the flow through recirculating conduit 58 so that no flow enters steam generator 20. Thus, when it is desired to lower the level of the fluid in steam generator 20, these combinations of pumping actions result in approximately a 75 gallon per minute decrease in the level of fluid in the steam generator 20.

In a typical nuclear steam generator 20, second channel head 36 or first channel head 34 can hold approximately 1150 gallons of water. In addition, the volume of water in approximately six feet of tubes 38 on only one leg of steam generator 20 is approximately 330 gallons. That is, the amount of water to raise the water level in steam generator 20 from slightly below tube sheet 28 to approximately six feet into tubes 38 (approximately four feet above tube sheet 28) is approximately 330 gallons of water. Therefore, with a 100 gallons per minute being introduced into second channel head 36 and with approximately 50 gallons per minute being removed from second channel head 36, the net increase in fluid level of approximately 50 gallons per minute would take approximately six-seven minutes to raise the level of fluid in steam generator 20 from slightly below tube sheet 28 to approximately six feet into tubes 38. Conversely, with flow control valve 56 diverting all the flow from first pump 54 through recirculating line 58 and with second pump 66 withdrawing fluid at the rate of approximately 75 gallons per minute the net decrease in fluid would be approximately 75 gallons per minute which would require approximately 4–5 minutes to go to low level.

Still referring to FIG. 2, filter 68 which may be a cartridge type filter for removing particulate matter from the fluid that is pumped therethrough is connected to surge tank 70 for accommodating variations in flows through filter 68. Surge tank 70 is connected to a third pump 72 which may be a centrifugal canned pump capable of operating between 50 gallons per minute and 75 gallons per minute. Third pump 72 is in turn connected to ion exchange system 74 which is used to remove the radioactive contaminates from the fluid and to reconstitute the decontamination solution before the solution is conducted, again, to tank 52. Ion exchange system 74 may be chosen from among those known in the art such as the one described in copending U.S. patent application Ser. No. 501,980, filed herewith, in the name of A. P. Murray, et al., and entitled Decontamination of Metal Surfaces in Nuclear Power Reactors, which is assigned to the Westinghouse Electric Corporation.

Still referring to FIG. 2, a temperature control system referred to generally as 78 is connected to the secondary side of steam generator 20 for circulating a fluid such as water on the secondary side of steam generator 28 for the purpose of maintaining the temperature of the decontamination solution in tubes 38. The water may be deionized water with approximately 75–150 ppm of hydrazine with the hydrazine being added to reduce the oxygen content and minimize corrosion. Temperature control system 78 may be connected to the secondary side of steam generator 20 by means of hand hole 80 which is located in outer shell 22 above tube sheet 28. In this manner, water may be circulated around tubes 38 and above tube sheet 28 for maintaining the temperatures of tubes 38 at an appropriate level thereby maintaining the temperature of the decontamination fluid within tubes 38 at the desired level.

Temperature control system 78 comprises a heater tank 82 which is capable of holding approximately 2300 gallons of water. A plurality of heaters 84 are disposed in heater tank 82 and connected to power source 86 for heating the water in heater tank 82. Heaters 84 may comprise two 100 kilowatt electric heaters for raising the temperature of the water in heater tank 82 to between 175°–250° F. and preferably to approximately 205° F.

Power source 86 may be a direct connection to a public utility electrical source.

Temperature sensor 88 may also be disposed in heater tank 82 for detecting the temperature of the water therein. Temperature sensor 88 may also be connected to a temperature monitor 90 for monitoring the temperature of the water in heater tank 82.

Heater tank 82 may be connected by heat insulated conduits to a feed pump 92 which may be a 25 gallon per minute centrifugal type pump. From feed pump 92, the water is pumped through second control valve 94 and into the secondary side of steam generator 20. A secondary side water level sensor 96 which may be a pressure sensitive detector may be disposed through hand hole 80 and into steam generator 20 for determining the height of the water on the secondary side of steam generator 20. Secondary side water level sensor 96 is connected electrically to second control valve 94 for adjusting the level of water on the secondary side of steam generator 20 at approximately four feet above tube sheet 28. In this manner, second control valve 94 is capable of throttling the flow from feed pump 92 so as to maintain the level of water on the secondary side of steam generator 20 at the appropriate level.

A fifth pump 98 is connected to hand hole 80 by appropriate conduits for the purpose of removing water from the secondary side of steam generator 20. Fifth pump 98 may be an air pump capable of pumping water therethrough at approximately 25 gallons per minute. Fifth pump 98 is connected by appropriate conduits to heater tank 82 for returning the water to heater tank 82. By circulating the water from heater tank 82 through steam generator 20 and back to heater tank 82, the temperature of the water on the secondary side of steam generator 20 may be maintained at approximately 200° F. This can be accomplished by flowing the water through the temperature control system 78 at approximately 25 gpm while maintaining the water in the lines at approximately 205° F.

OPERATION

When it is desired to radioactively decontaminate steam generator 20, steam generator 20 is deactivated and drained of both the primary coolant and the secondary side water. Next, fluid control system 50 is connected to one of the channel heads of steam generator 20 such as second channel head 36 and temperature control system 78 is connected to hand hole 80 of the secondary side of steam generator 20.

With temperature control system 78 connected to the secondary side of steam generator 20, temperature control system 78 is activated which causes heaters 84 to be activated thus heating the water in heater tank 82 to approximately 205° F. When the water in heater tank 82 has reached a temperature of approximately 205° F., as determined by temperature sensor 88 and temperature monitor 90, feed pump 92 is activated which causes the water to be pumped from heater tank 82 through second control valve 94 and into the secondary side of steam generator 20. This is continued until secondary side water level sensor 96 indicates that the water level on the secondary side of steam generator 20 is approximately 4 feet above tube sheet 28. In this condition, the water on the secondary side of steam generator 20 surrounds tubes 38 on both the hot leg and the cold leg sides of the steam generator. When the water level on the secondary side of steam generator 20 has reached the desired level, fifth pump 98 is activated which causes water to be pumped from steam generator 20 at the rate of approximately 25 gallons per minute and back to heater tank 82. This process is continued until a steady state is achieved so that the water on the secondary side of steam generator 20 is at approximately 200°–205° F. When temperature control system 78 has reached this steady state condition, approximately 4 feet of tubes 38 extending beyond tube sheet 28 are also at approximately 200° F. such that any decontamination solution introduced into those tubes 38 at that level will also be able to be maintained at approximately 200° F.

Fluid control system 54 is also activated by activating first pump 54 which causes approximately 100 gallons per minute of decontamination solution to be pumped from tank 52 through flow control valve 56 and into second channel head 36. Since first pump 54 is introducing decontamination solution into second channel head 36 at the rate of approximately 100 gallons per minute and since the fluid capacity of second channel head 36 is approximately 1150 gallons, the time necessary to fill second channel head 36 at the rate of 100 gallons per minute is approximately 12 minutes. In addition, since the volume of approximately 6 feet of tubes 38 that are immediately connected to second channel head 36 is approximately 330 gallons, the time necessary to additionally fill tubes 38 to approximately 6 feet of length (4 feet above tube sheet 28) is approximately 4 minutes. Thus, the time necessary to fill both second channel head 36 and the desired portion of tubes 38 is approximately 16 minutes at the rate of increase of 100 gallons per minute. When the level of decontamination solution has reached the appropriate level in tubes 38, as determined by fluid level sensor 60, fluid level sensor 60 can send a signal to controller 62 which can in turn send a signal to flow control valve 56 thereby throttling back flow control valve 56 so as to allow only 50 gallons per minute to pass therethrough and into steam generator 20. When in this condition, approximately 50 gallons per minute of decontamination solution is flowing through flow control valve 56 and approximately 50 gallons per minute of decontamination solution is being recirculated through recirculating conduit 58. Controller 62 also sends a signal to second pump 66 to activate second pump 66 so as to begin withdrawing decontamination solution from second channel head 36 at the rate of approximately 50 gallons per minute. In this steady state condition, the level of decontamination solution in steam generator 20 can be maintained at the high level. Controller 62 can be programmed to allow the high level condition to be maintained for approximately 0 to 15 minutes or it can be programmed to immediately begin the drain down cycle.

In the drain down cycle, controller 62 completely closes flow control valve 56 which causes the entire flow of decontamination solution through first pump 54 to be recirculated through recirculating conduit 58 and back to tank 52. At the same time, controller 62 increases the flow through second pump 66 from 50 gallons per minute to 75 gallons per minute. In this drain down cycle, 75 gallons per minute is being pumped from second channel head 36 at the rate of 75 gallons per minute while no decontamination solution is being added thereto. Therefore, at this rate of 75 gallons per minute, tubes 38 will be drained of decontamination solution in approximately 4–5 minutes. When tubes 38 have been completely drained of decontamination solution, fluid level sensor 60 can determine that the level of fluid in second channel head 36 is to a level just below tube sheet 28 and thus begin the refill cycle.

In the refill cycle, controller 62 causes flow control valve 56 to be completely opened thus allowing 100 gallons per minute of decontamination solution to be introduced into second channel head 36 while at the same time throttling back second pump 66 to a 50 gallon per minute rate. Thus, decontamination solution is being introduced to second channel head 36 at a net increase rate of 50 gallons per minute so that the level of decontamination solution in second channel head 36 can be raised from just below the level of tube sheet 28 to approximately 6 feet into tubes 38. Because it takes approximately 330 gallons of decontamination solution to raise the level in steam generator 20 from just below tube sheet 28 to 6 feet into tubes 38, at the rate of approximately 50 gallons per minute, the time necessary to refill tubes 38 is approximately 6–7 minutes.

This draining and refilling of tubes 38 is sometimes referred to as a "bump cycle" and serves the purpose to reconstitute the composition of the decontamination solution in tubes 38. Since in the operating condition, decontamination solution is constantly flowing through the channel head, the composition of the decontamination solution in second channel head 36 is constantly being reconstituted. However, since the fluid in tubes 38 is relatively stagnant in the operating condition, it is necessary to drain and refill tubes 38 so that decontamination solution in tubes 38 may be reconstituted. Therefore, the drain and refill cycle provides a means by which the composition of the decontamination solution in tubes 38 may be maintained at the proper level.

Throughout this process, the decontamination solution is being circulated through filter 68 for the purpose of removing particulate matter therefrom and through ion exchange system 74 for the purpose of removing the radioactive contaminates and for reconstituting the decontamination solution before the solution is returned to tank 52 for reuse.

While the invention has been described herein as being applied to only one side of steam generator 20, it is readily understood that by connecting fluid control system 50 to both first channel head 34 and second channel head 36 and adjusting the flow rates accordingly, both sides of steam generator 20 may be radioactively decontaminated at the same time. Typically, when only one channel head is being decontaminated, the other channel head is vented to the atmosphere. Since the channel heads are connected to each other by tubes 38, venting of one of the channel heads facilitates the filling of the other channel head with the decontamination solution. In such cases, it is advisable to limit the pressure of the decontamination solution in the channel head to approximately 10 psi to avoid pumping the decontamination solution through tubes 38 and into the other channel head.

In addition, a rinsing of steam generator 20 may be conducted in a manner similar to the use of the decontamination solution as described herein.

Therefore, it can be seen that the invention provides a means by which an appropriately selected decontamination solution may be effectively circulated through the primary side of nuclear steam generator 20 for the purpose of removing radioactive contamination therefrom while temperature control system 78 maintains the temperature of the decontamination solution in tubes 38.

We claim as our invention:

1. A method for decontaminating a radioactively contaminated nuclear steam generator comprising:

introducing a decontamination solution into a channel head of said steam generator and filling said channel head and a portion of the heat exchange tubes adjacent to said channel head to a predetermined level with said decontamination solution for removing radioactive contaminants from the surfaces of said channel head and said tubes;

circulating said decontamination solution through said channel head while maintaining said decontamination solution in said tubes;

lowering the level of said decontamination solution until said decontamination solution is drained from said tubes while circulating said decontamination solution through said channel head;

raising the level of said decontamination solution until said decontamination solution reaches said predetermined level while circulating said decontamination solution through said channel head; and removing said decontamination solution from said steam generator.

2. The method according to claim 1 wherein said step of circulating said decontamination solution through said channel head comprises simultaneously introducing and withdrawing said decontamination solution from said channel head.

3. The method according to claim 2 wherein said step of lowering the level of said decontamination solution comprises discontinuing said introduction of said decontamination solution and increasing said withdrawal of said decontamination solution.

4. The method according to claim 3 wherein said step of raising said level of said decontamination solution comprises introducing said decontamination solution into said channel head at a predetermined rate while withdrawing said decontamination solution at a rate less than said predetermined rate until said decontamination solution in said tubes reaches said predetermined level.

5. The method according to claim 4 wherein said step of raising said level of said decontamination solution further comprises withdrawing said decontamination solution at a rate of approximately one half of said predetermined rate.

6. The method according to claim 5 wherein said method further comprises:

circulating heated water on the secondary side of said steam generator and around said tubes for heating said tubes and said decontamination solution therein to a desired temperature; and maintaining the level of said heated water on said secondary side at approximately said predetermined level of said decontamination solution in said tubes.

7. The method according to claim 6 wherein said step of circulating heated water comprises circulating water heated to approximately 200° F. and at approximately 25 gallons per minute.

8. The method according to claim 1 wherein said step of raising said level of said decontamination solution further comprises introducing said decontamination solution into said channel head at a rate of approximately 100 gallons per minute while withdrawing said decontamination solution at a rate of approximately 50 gallons per minute.

9. The method according to claim 8 wherein said step of lowering the level of said decontamination solution comprises discontinuing said introduction of said decontamination solution and increasing said withdrawal of said decontamination solution to approximately 75 gallons per minute.

10. A method for decontaminating a radioactively contaminated nuclear steam generator comprising:

introducing a decontamination solution into a channel head of said steam generator and filling said channel head and a portion of the heat exchange tubes adjacent to said channel head to a predetermined level with said decontamination solution for removing radioactive contaminants from the surfaces of said channel head and said tubes;

circulating said decontamination solution through said channel head while maintaining said decontamination solution in said tubes;

lowering the level of said decontamination solution until said decontamination solution is drained from said tubes while circulating said decontamination solution through said channel head;

raising the level of said decontamination solution until said decontamination solution reaches said predetermined level while circulating said decontamination solution through said channel head;

circulating heated water on the secondary side of said steam generator and around said tubes for heating said tubes and said decontamination solution therein to a predetermined temperature; and maintaining the level of said heated water on said secondary side at approximately said predetermined level of said decontamination solution in said tubes.

11. The method according to claim 10 wherein said step of circulating heated water comprises monitoring the temperature of said heated water for maintaining the temperature of said heater water.

12. The method according to claim 11 wherein said heated water comprises deionized water and hydrazine.

13. The method according to claim 12 wherein said heated water comprises approximately 75–150 ppm of hydrazine.

14. The method according to claim 13 wherein said heated water is maintained at approximately 200° F.

15. The method according to claim 14 wherein said heated water is circulated on said secondary side of said steam generator at approximately 25 gpm.

* * * * *